United States Patent [19]

Plummer

[11] Patent Number: 5,070,856

[45] Date of Patent: Dec. 10, 1991

[54] HAND/BOW INTERFACE FOR ARCHERY BOW

[76] Inventor: Paul L. Plummer, 6112 Murray La., Brentwood, Tenn. 37027

[21] Appl. No.: 427,190

[22] Filed: Oct. 26, 1989

[51] Int. Cl.[5] ..... F41B 5/00

[52] U.S. Cl. ..... 124/88; 124/23.1; 2/161 A

[58] Field of Search ..... 124/23.1, 25.6, 86, 124/88; 2/160, 161 R, 161 A; 272/67, 68

[56] References Cited

U.S. PATENT DOCUMENTS

| | | | |
|---|---|---|---|
| 3,176,674 | 4/1965 | Smith | 124/23.1 |
| 3,397,685 | 8/1968 | Walker | 124/88 |
| 3,415,241 | 12/1968 | Bear | 124/88 X |
| 3,538,902 | 11/1970 | Fowkes | 124/23.1 X |
| 4,146,935 | 4/1979 | Hinton | 2/161 A |
| 4,175,536 | 11/1979 | Carella | 124/23.1 |
| 4,624,016 | 11/1986 | Luevano | 2/161 A |

*Primary Examiner*—Peter M. Cuomo
*Assistant Examiner*—John A. Ricci
*Attorney, Agent, or Firm*—Mark J. Patterson; Edward D. Lanquist, Jr.

[57] ABSTRACT

An interface between an archer's hand and an archery bow is provided whereby low friction, slidable movement of the hand at the hand-bow contact point is made independent of the bow. Lubricated latex rubber is disposed between the hand and the bow by means of an archer's glove, or a permanent or removable grip.

5 Claims, 4 Drawing Sheets

HAND/BOW INTERFACE FOR ARCHERY BOW

BACKGROUND OF THE INVENTION

The present invention relates to grips for archery bows and more particularly to means for providing an interface between the bow and the archer's hand.

As the use of archery equipment for recreational target competition and hunting has become more popular, the demand for more powerful and accurate archery bows has increased. Consequently, mechanically advantaged compound bows have been developed which allow the archer to deliver high levels of thrust to the arrow. Sophisticated sighting and error correction mechanisms are also being employed.

Of course, the ultimate accuracy of a properly sighted arrow will largely depend upon the stability and proper placement of the archer's extended arm and hand with respect to the grip of the bow. Unfortunately, the newer more powerful bows place a greater premium on this factor because of the correspondingly greater forces applied at the interface between the hand and bow. These forces produce what is commonly referred to as bow torquing. That is, if the archer intentionally or accidentally adjusts the position of his hand and wrist in the horizontal plane, such as when he is forced to shoot from a less than ideal position, the frictional forces produced at the hand-bow interface will cause undesirable alteration in the orientation of the bow itself, and whereby the grip will no longer be properly centered in the hand which grips it.

Many archers and bow manufacturers have overlooked this problem and continue to produce a hand-bow interface which seeks to increase the friction at the interface. For example, most contemporary compound bows have grips made of hard plastic or rubber. Frequently, the manufacturer or after market supplier will suggest the use of a tennis grip-type or cork interface material to prevent slipping of the grip at the point where it meets the hand, between the thumb and forefinger. This interface actually increases the tendency toward bow torquing. A similar approach has been taken by users of archery gloves.

Recognizing the need for allowing slight variations in the hand and wrist angle while maintaining a properly aimed bow, the prior art has addressed the problem at the grip-bow interface. That is, bows have been designed whereby the grip assembly can rotate on its vertical axis independently from the rest of the bow. Examples of this arrangement can be seen in U.S. Pat. Nos. 3,397,685; 3,538,902; 4,252,100; and 4,457,287. To this inventor's knowledge, none of these designs have been commercially used. It is apparent that these grips are quite complex mechanically, thereby increasing the cost and weight of the bow while decreasing its reliability.

What is needed, then, is a reliable means for minimizing archery bow torquing that does not significantly add to the cost or weight of the bow.

SUMMARY OF THE INVENTION

The present invention solves the bow torquing problems of the prior art archery bows and grips by means of a novel but simple interface between the archer's hand and the bow. Therefore, the hand-bow interface of the present invention provides a slidable, low friction hand-bow contact point by use of a lubricated and resilient latex rubber material that, when the contact point is under tension, will "give" in all directions as well as accommodate smooth rotation of the hand and wrist without corresponding deflection or rotation of the bow itself. The grip of the bow remains properly centered in the hand. The several embodiments of the interface include a glove, a permanent or removable grip wrap or cover, or a combination of these.

DESCRIPTION OF THE PREFERRED EMBODIMENT

The principal feature of the archery bow hand-bow interface of the present invention is the use of material at the hand-bow contact point which allows the hand and wrist to rotate or pivot independently from the grip when under tension. Through experimentation, it has been discovered that a lubricated latex rubber similar to what is used for surgical gloves is an ideal material. Lubrication can be obtained from a petroleum based jelly, silicone, KY Jelly ® (a trademark brand name), or other durable, nontoxic and water resistant lubrication that adheres to a latex surface. Also, the use of an interface material such as Teflon ® (a trademark brand name for a product from E. I. du Pont de Nemours and Company) without a lubricant is also possible. It is preferred that the interface material have resiliency so as to "give" in all directions, thereby accommodating slight repositioning of the hand contact point without disturbing the targeting of the bow and while maintaining the proper centering of the grip between the thumb an forefinger.

Figure 1:
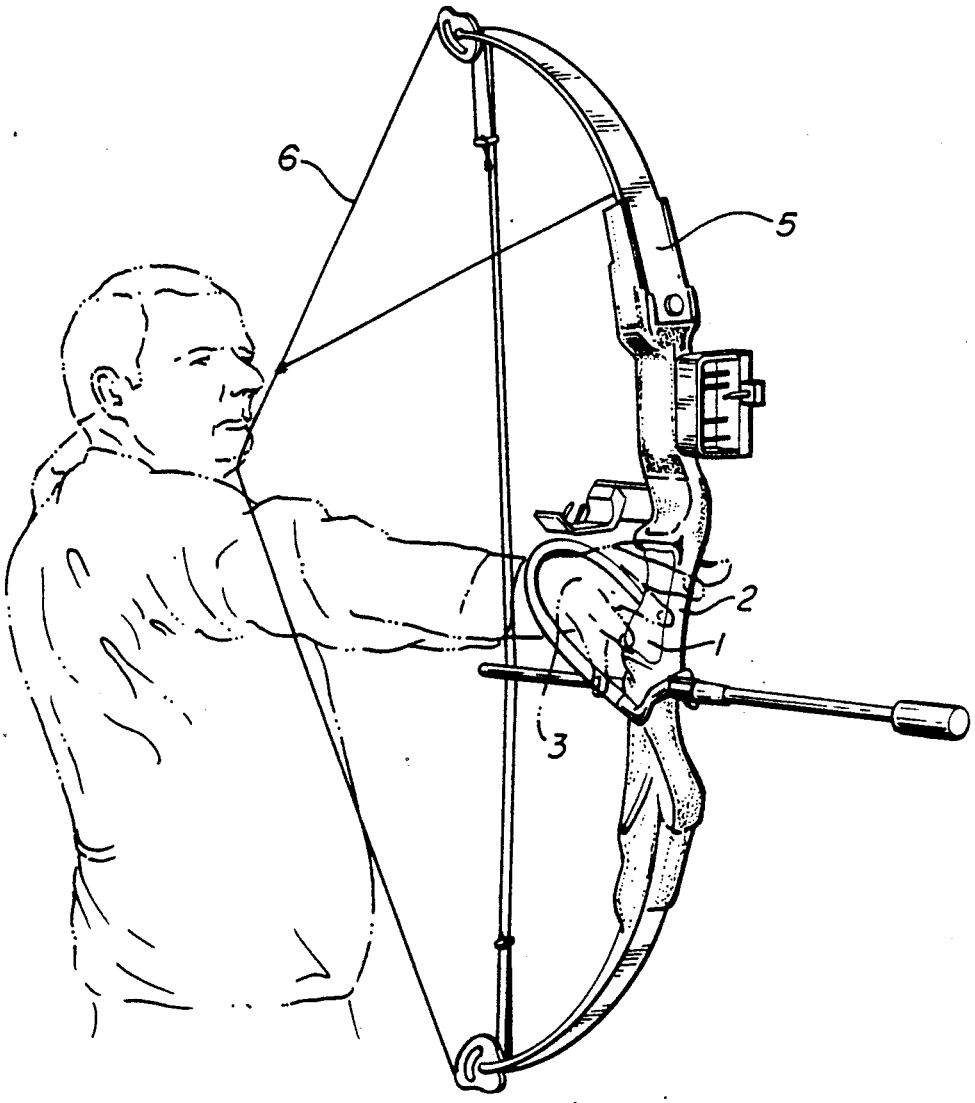
FIG. 1 is an isometric view of the archery bow hand-bow interface in use as implemented by means of a grip cover.
Figure 2:
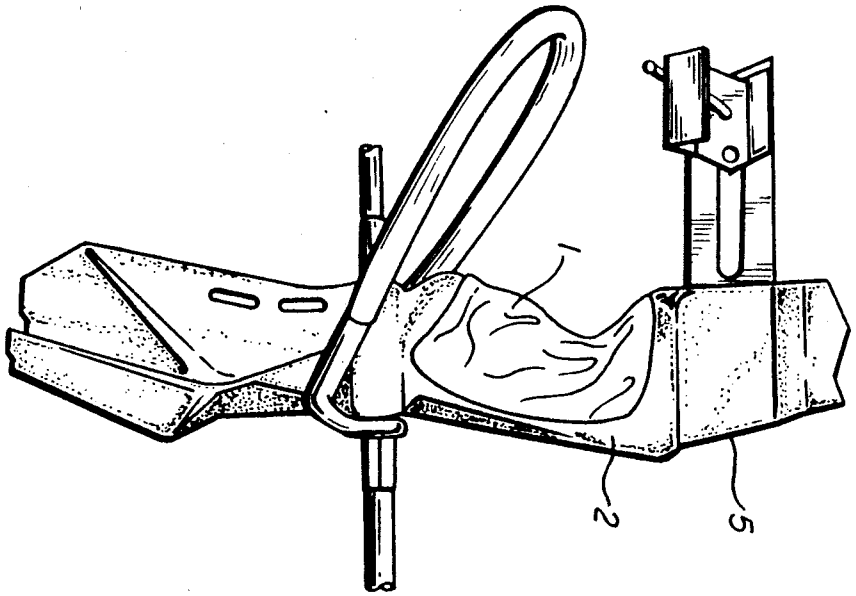
FIG. 2 is an enlarged view of the bow grip and cover of FIG. 1.

As can be seen in FIGS. 1 and 2, one simple embodiment of the interface of the present invention is a permanent cover 1 of a standard bow grip 2 with surgical latex rubber, partially lubricated with petroleum jelly between said grip 2 and said cover 1. Grip 2 can also be a snap-on grip widely known in the art. Cover 1 attachment to grip 2 is designed to fully contain the lubricant between Cover 1 and grip 2. Cover 1 is fixed to grip 2 using a conventional adhesive or other means, preferably at peripheral areas which are relatively distant from the grip contact point 4 of hand 3. This allows the interface to take advantage of the omni-directional resiliency of the latex rubber. As can best be visualized from FIG. 1, hand 3 can now freely rotate on its vertical axis at the contact point 4 with grip 2. Tension applied to the bow 5 by the drawn bowstring 6 causes the bow 5 to continuously adjust its position at the contact point 4 so as to retain a properly centered position between the thumb and forefinger of hand 3.

Figure 3:
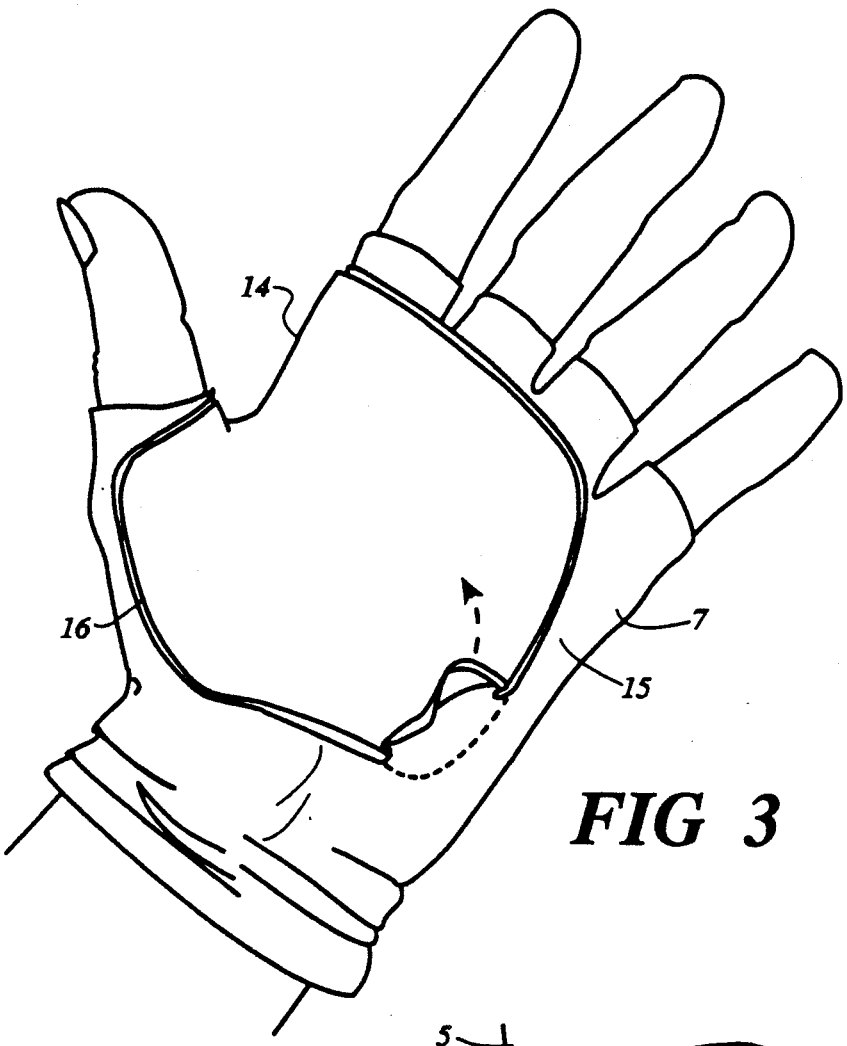
FIG. 3 is an enlarged view of the hand-bow interface implemented by means of an archer's glove.

FIG. 3 shows an alternative embodiment of the interface, implemented by means of a pad 14, preferably made of latex rubber, being attached to palm portion 15 of glove 7, preferably fingerless. Glove 7 conventionally attaches to the outside edge of pad 14. Tuck 16 is placed around the outside edge of pad 14 to provide an extra fold of material to allow pad 14 to "give" in relation to glove 7. The contact surface between pad 14 and glove 7 can be lubricated to ensure slidability. Attachment of pad 14 to glove 7 fully contains lubricant in the interface between pad 14 and glove 7.

Figure 4:
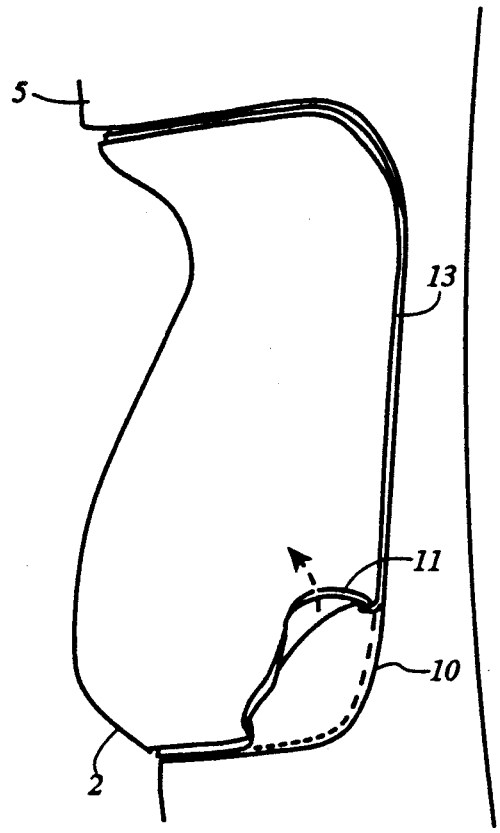
FIG. 4 is an enlarged view of the hand-bow interface implemented by means of a removable grip.

FIG. 4 shows another embodiment of the present invention in which the interface is implemented by means of a removable grip 2 which partially encircles the rearwardly facing surface of bow 5 and releasably attaches to bow 5 by conventional means such as a hook and loop type fabric or snaps. Removable grips 2 are widely known in the art and can also be attached with snaps. Removable grip 2 consists of a first section 10 that in the preferred embodiment is rigid and molded to conform to bow 5. Second section 11 covers the outer surface of first section 10. Second section 11 conventionally attaches to the edge of first section 10. Prior to attachment, tuck 13 is placed around second section 11 to allow second section 11 to "give" with respect to first section 10. In the preferred embodiment, second section 11 is surgical latex rubber. The surface between second section 11 and first section 10 can be coated with a lubricant to ensure slidability. Removable grip 2 allows the archer to employ either grip 2 as shown in FIG. 4 or an uncovered, conventional grip (not shown).

Figure 5:
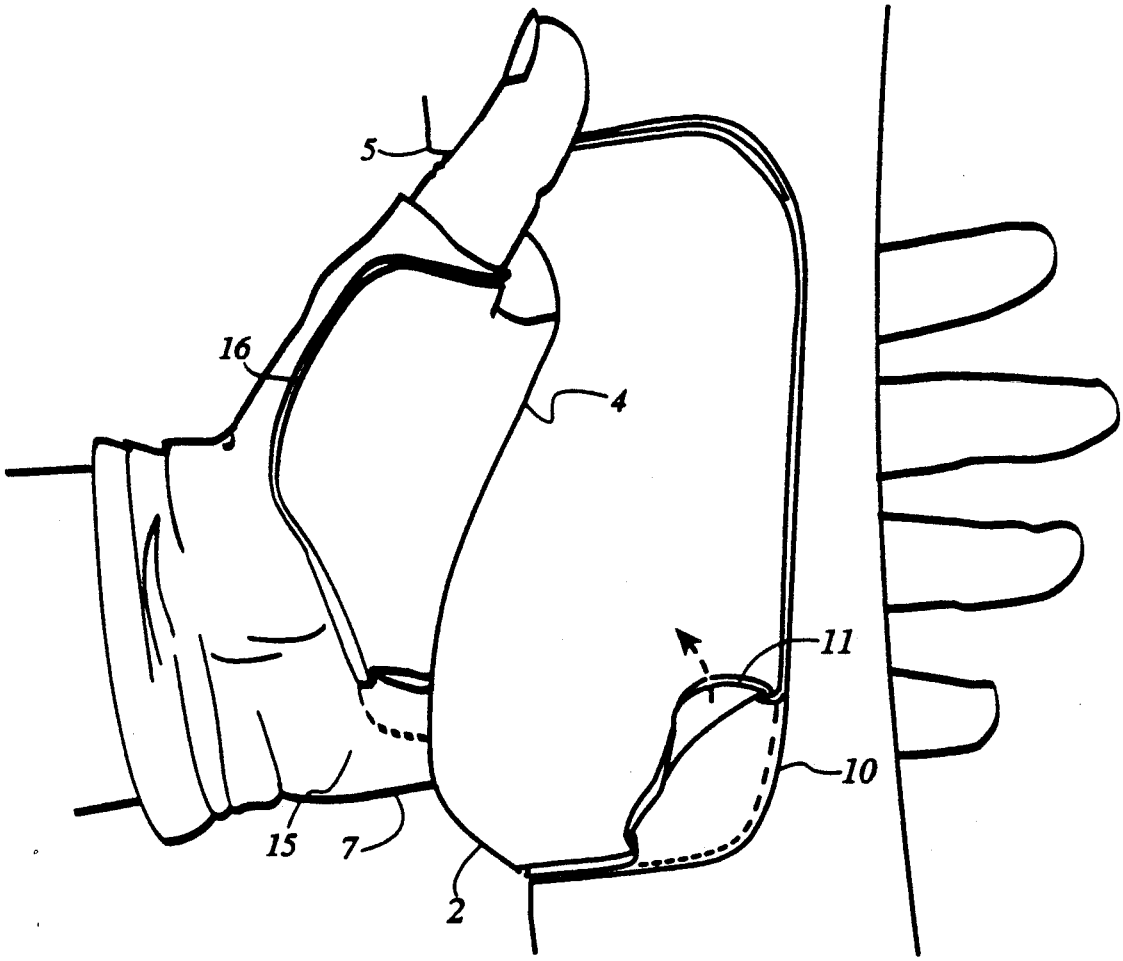
FIG. 5 is an enlarged view of the hand-bow interface implemented by means of a combination of a grip cover and archer's glove.

Finally, FIG. 5 shows yet another embodiment offering maximum slidability at the hand-bow contact point 4 by use of the combination of a glove 7 and removable grip 2. Also, analogously, permanent cover 1 shown in FIG. 1 can also be combined with removable grip 2 in FIG. 4 to provide the same type interface. Further, glove 7 can be used in combination with any standard grip.

What I claim is:

1. An interface between an archery bow having a grip and the archer's hand comprising:

(a) a cover means disposed between said hand and said grip at a point where said hand contacts said grip when said bow is drawn and ready for firing;

(b) said cover means adapted for low friction, omni-directional, slidable movement of said hand independent of said grip at said contact point;

(c) first lubricating means between said cover means and said grip;

(d) a slidable pad attached to the palm area of a glove on said hand; and (e) second lubricating means being disposed between said slidable pad and said glove.

2. An interface between an archery bow having a grip and the archer's hand comprising:

(a) a cover means disposed between said hand and said grip at a point where said hand contacts said grip when said bow is drawn and ready for firing;

(b) said cover means adapted for low friction, omni-directional, slidable movement of said hand independent of said grip at said contact point;

(c) first lubricating means between said cover means and said grip;

(d) said cover means disposed between said hand and said grip by means of a slidable pad for a glove for said hand; and (e) second lubricating means being disposed between said slidable pad and said glove.

3. The interface of claim 2 where said grip is removable.

4. The interface of either of claims 1, 2, or 3 where said cover means comprises latex rubber and where said interface further comprises a lubricating material at said hand-bow contact point.

5. An interface between an archer's hand and an archery bow having a grip comprising:

(a) a first cover means partially encircling said bow proximate to where said hand contacts said bow during firing;

(b) a second cover means slidably contacted with and partially encircling said first cover means, thereby allowing omni-directional slidable movement of said hand independent of said grip; and (c) lubricating means placed between said first cover means and said second cover means.

* * * * *